US007117861B2

(12) United States Patent
Labbe

(10) Patent No.: US 7,117,861 B2
(45) Date of Patent: Oct. 10, 2006

(54) METHOD FOR CONTROLLING AN INTERNAL COMBUSTION ENGINE

(75) Inventor: Magnus Labbe, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/149,044

(22) Filed: Jun. 8, 2005

(65) Prior Publication Data

US 2006/0016440 A1 Jan. 26, 2006

(30) Foreign Application Priority Data

Jul. 24, 2004 (DE) ..... 10 2004 036 034

(51) Int. Cl.
*F02D 41/14* (2006.01)
*F01N 3/00* (2006.01)

(52) U.S. Cl. ..... 123/673; 701/109; 60/285

(58) Field of Classification Search ..... 123/673, 123/688, 691–692, 703; 701/103–105, 109; 60/274, 276–277, 285; 73/117.1, 118.1
See application file for complete search history.

(56) References Cited

U.S. PATENT DOCUMENTS 5,275,142 A * 1/1994 Kapellen et al. ..... 123/436
5,381,656 A * 1/1995 Orzel et al. ..... 60/274
6,105,366 A * 8/2000 Zhang ..... 60/274
6,799,419 B1 * 10/2004 Rosel et al. ..... 60/277

FOREIGN PATENT DOCUMENTS

| | | |
|---|---|---|
| DE | 38 39 611 | 5/1990 |
| DE | 199 552 52 | 6/2001 |
| DE | 102 06 402 | 4/2003 |

* cited by examiner

*Primary Examiner*—Hai Huynh
(74) *Attorney, Agent, or Firm*—Kenyon & Kenyon LLP

(57) ABSTRACT

A method for controlling an internal combustion engine in which in each case the lambda value is ascertained by evaluating a measuring signal of a lambda probe. In this context, two combustion periods of the internal combustion engine are compared to each other. In the two combustion periods, in a single cylinder the lambda value is induced once in the direction of a lambda increase and once in the direction of a lambda decrease.

5 Claims, 1 Drawing Sheet

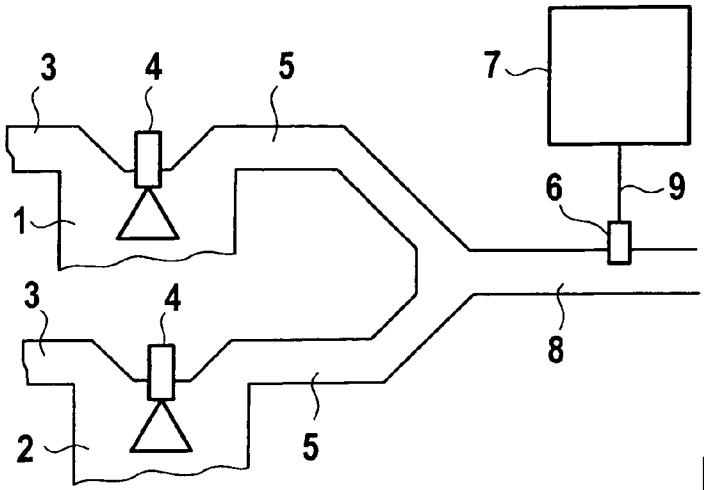
Fig. 1
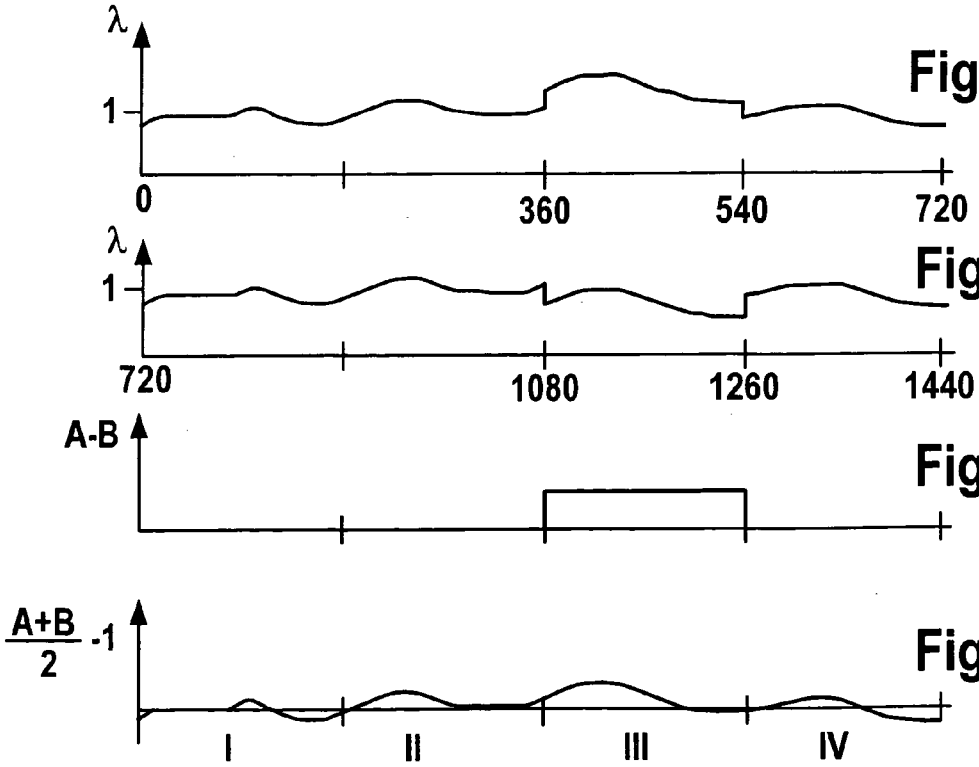
Fig. 2A
Fig. 2B
Fig. 2C
Fig. 2D

METHOD FOR CONTROLLING AN INTERNAL COMBUSTION ENGINE

BACKGROUND INFORMATION

Methods are known for controlling internal combustion engines having several cylinders, in which a lambda signal of a lambda probe in the exhaust gas of the internal combustion engine is ascertained. This signal is used to induce (influence) the ratio of air to fuel in such a way that a predefined setpoint lambda value is achieved.

SUMMARY OF THE INVENTION

The method according to the present invention has the advantage that the measured lambda value (air/fuel ratio) is linked to an individual cylinder, in a particularly simple manner. This makes it possible, in a particularly simple manner, to identify an individual cylinder of the plurality of cylinders, and to induce the lambda value for this cylinder on an individual basis.

The inducement of the lambda change in the direction of increasing or lowering may be taken into consideration in a particularly simple manner by evaluating the curve over time of the lambda signal. This may be done especially simply if the signal of the lambda probe and the square of the signal of the lambda probe are respectively summed up for each of the two combustion periods. It is then not necessary to store the entire course over time, but it is sufficient to store the summed-up values. The requirement for storage space and the computing expenditure are thereby kept especially low.

For the improvement of the accuracy of the determined lambda value for the individual cylinder, one may also observe a plurality of two combustion periods. The lambda value thus ascertained may be used for the regulation of the lambda value of an individual cylinder at which the lambda values are increased and lowered. To improve the lambda value of all cylinders, the method may be carried out successively at all the cylinders.

BRIEF DESCRIPTION OF THE DRAWINGS

FIG. 1 shows an internal combustion engine.

FIGS. 2A–2D show various signal curves plotted against time.

DETAILED DESCRIPTION

FIG. 1 schematically shows an internal combustion engine having a first cylinder 1 and a second cylinder 2. Air is supplied via an air supply 3 to each of the two cylinders 1, 2. A quantity of fuel is then injected by a fuel injector 4 respectively into the combustion chambers of cylinders 1, 2 and is combusted there. The combustion products of this combusted fuel are led away from cylinders 1, 2 through exhaust pipes 5, and flow in common into an exhaust gas collecting pipe 8. In collecting pipe 8, a lambda probe 6 is provided which evaluates the composition of the combustion exhaust gases of cylinders 1, 2. In this context, especially the remaining oxygen content of the exhaust gas is tested for. The measured values of lambda probe 6 are conducted by an appropriate signal line 9 to a control unit 7, which performs the corresponding computations based on the lambda signal.

FIG. 1 shows a two-cylinder internal combustion engine. The usual internal combustion engines, as used in motor vehicles, as a rule have a larger number of cylinders, and four-cylinder engines are particularly widespread. Showing two cylinders was selected here only for reasons of clarity. Also, cylinders 1, 2 were shown only schematically. In cylinders 1, 2 a piston is also provided in each case, that is not shown here, and it is set into motion based on the increased pressure created in cylinders 1, 2 by the combustion of the fuel in air. Furthermore, intake valves are usually provided for the air supply through intake duct 3, and these are not shown here either. In the case of internal combustion engines, outlet valves are usually provided, which seal the combustion chamber of cylinders 1, 2 from exhaust gas pipes 5. By opening and closing the intake and outlet valves, the combustion chamber of cylinders 1, 2 is filled with fresh air from intake duct 3, fuel is injected by fuel injector 4, combustion takes place, and then the outlet valves are opened in order to pass out the exhaust gases of the combustion through exhaust gas pipe 5 and exhaust gas collecting pipe 8 to the exhaust, or rather to the environment.

The composition of the exhaust gas, in particular the oxygen content, is determined by lambda probe 6. However, the signal of lambda probe 6, or rather the oxygen content of the exhaust gas, varies during the measurement. Furthermore, the assignment of the measured lambda signal to the individual cylinders is problematical, i.e. it cannot be clearly judged whether a currently measured value of the composition of the exhaust gas originates from cylinder 1 or from cylinder 2. However, this would be desirable, in order to make possible a correction of the injected fuel quantities for each of the two cylinders 1, 2 respectively, and in order to achieve in each of the two cylinders 1, 2 an optimal approximation of the lambda value of the exhaust gas to a desired setpoint value (which is usually 1), during each combustion. Differences in the lambda values between the two cylinders 1, 2 come about, on the one hand, by different air charges, i.e. differences in the development of intake ducts 3, either based on construction or on manufacturing, lead to a different charge of the individual cylinders. There may also be fluctuations between fuel injectors 4. It is therefore desirable to be able to assign the signals measured by lambda probe 6 to the individual cylinders 1, 2, in order to make possible appropriate measures for regulating the lambda value of the respective individual cylinder. An appropriate regulating intervention may be made, both at fuel injectors 4 by influencing the injection time, and at corresponding actuating mechanisms of intake duct 3, such as an intake valve.

Now, in order to make possible an assignment of the signals of lambda probe 6 to individual cylinders 1, 2, it is provided according to the present invention, to evaluate at least two combustion periods of an individual cylinder. In this context, in one and the same cylinder, the first time the charge with air or fuel is induced in the direction of an increase in the lambda value, and the second time in the direction of a decrease in the lambda value. Because of this measure, it is then possible to assign the measured lambda signals to the corresponding cylinder, and to take up corresponding measures for regulating the lambda value of the individual cylinder.

FIGS. 2A–2D show, for a four cylinder, four-stroke internal combustion engine, the signal curve of the lambda signal over two subsequent combustion periods of the internal combustion engine, and signals derived from this. FIG. 2A shows the lambda signal in an angular range between 0 and 720° of crankshaft angle. In this context, the range from 0 to 180° is assigned to a first cylinder 1, the range from 180 to 360° to a cylinder 2, the range from 360 to 540° to a cylinder 3 and the range from 540 to 720° to a fourth cylinder 4, i.e. in these angular ranges, the exhaust gases of the cylinders correspondingly flow past lambda probe 6. Using appropriate measures, such as an appropriately shortened activation of fuel injector 4, the lambda signal of cylinder 3 was raised in the direction of a lambda increase above the value 1 (i.e. a lean mixture). This may also be recognized in the signal curve of curve A in that, at 360° there is a step to higher lambda values, and at 540° a return step to lower lambda values. The sharpness of the step and the height of the step were idealized in this case, and shown at an increased height. In the same cylinder 3, at the directly following combustion, which then takes place in an angular range between 720 and 1440°, the lambda value was changed in the rich direction, i.e. at lower lambda values, clearly lower than 1. The lambda curve of this signal is shown in curve B, in which, at an angle of 1080°, there is a step in the direction of a richer lambda value less than 1, and at 1260° there is a return step in the direction of a leaner lambda value.

Thus, in curves A and B, the signal of the lambda probe plotted against an angle of 0 to 1440° is involved, i.e. two combustion periods of the internal combustion engine, in the first combustion period between 0 and 720° in cylinder 3, an adjustment in the direction of a higher lambda value taking place, and in the second combustion period from 720 to 1440°, an adjustment in the direction of a lower lambda value taking place. In the other cylinders, i.e. cylinders 1, 2 and 4, there is no such adjustment, i.e. in these cylinders it was attempted to remain as close as possible to the value of lambda, equal one, that was here predefined as the setpoint value. All the same, slight fluctuations come about which, however, as shown here, are the same for both curves. The absolute equality of these curves for cylinders 1, 2 and 4 is, of course, not as ideal in the case of real systems as is shown here. In real internal combustion engines there are also slight differences which, however, simply stem from statistical fluctuations, and are not based on systematic differences.

FIG. 2C and FIG. 2D then show derived signals, i.e. signals that result from a calculation of curves A and B. FIG. 2C shows the difference signal A–B. Since the signals of curves A and B are the same for cylinders 1, 2 and 4, the difference yields the value zero in this case. In the area of cylinder 3, the difference of these two curves is equivalent to twice the selected adjustment, i.e. the lambda increase of curve A and the lambda reduction of curve B add up to the value shown in curve C. What is plotted in FIG. 2C is the difference signal with respect to the angle of the combustion period from 0 to 720°.

FIG. 2D shows a plot of the average value of the two curves A and B less the setpoint value with respect to the angle from 0 to 720° of one combustion period. The value (A+B)/2 is the arithmetic average of the two curves A and B. The setpoint value (here lambda=1) was then subtracted from this arithmetic average. In the area of cylinders 1, 2 and 4, this corresponds simply to the fluctuation of the lambda values about the value 1, as was shown in FIGS. 2A and 2B. In the area of cylinder 3, by the formation of the arithmetic mean, the additionally generated lambda displacement of curve A and curve B with respect to each other is canceled, since in curve A there was an adjustment by the same value in the direction of a lambda increase as was made in curve B in the direction of a lower lambda value. Consequently, FIG. 2D shows the deviations of the individual cylinders from the lambda setpoint value 1.

If curve D is present, and it is clear how one should assign the signal to the individual cylinders, then by this curve D alone a lambda regulation could take place for each individual one of the four cylinders of the four cylinder internal combustion engine. Since, however, it is not known at which point in time the lambda signal is to be attributed to which cylinder, one cannot ascertain from curve D how each individual cylinder is to be induced. The subdivision by cylinder 1, 2, 3, 4, as shown here, therefore has only an illustrating character. However, by an overall examination of FIGS. 2C and 2D it is possible to detect the proportion of the lambda signal that originates from cylinder 3. This simply takes place in that the signal of FIG. 2C is used to identify in FIG. 2D the range attributable to cylinder 3. The variation of the lambda signal of an individual cylinder in two subsequent combustions thus makes possible the detection of the respective cylinder in the curve over time of the lambda signal. However, this procedure requires storing all measured values between 0 and 720° or between 720 and 1440°, and consequently requires a relatively high storage.

However, as one may see from the following mathematical examination of these curves, it is not necessary to store the entire curves.

The signal curve shown in FIG. 2A may be represented as vector A, the vector being made up of a sequence of individual vales $a_i$. Correspondingly, curve B may also be represented by vector B having individual elements $b_i$, and the curve over time of the setpoint value as vector SOLL (SETPOINT) having individual elements soil. Accordingly, one obtains curve C, in which the two vectors A and B are subtracted from each other. Curve D comes about by the two vectors being added, divided by two, and the setpoint value (in the example as in FIGS. 2A–2D the setpoint value amounts to one) is deducted. When forming the product of the two curves C and D, in areas 1, 2 and 4 the value is zero, since there curve C is also zero. In area 3, the product is formed of the deviating size times the actual value deviation as shown in FIG. 2D. In vector notation, this yields $$(A-B)((A+B)/2-\mathrm{SOLL}))=\Sigma((a_i-b_i)*(0.5*(a_i+b_i)-\mathrm{soll}_i)$$

If $\mathrm{soll}_i$ is assumed to be constant as soll, this simplifies to $$0.5\Sigma a_i^2-0.5\Sigma b_i^2-\mathrm{setpoint}\ \Sigma a_i+\mathrm{setpoint}\ \Sigma b_i$$

The result of this multiplication thus delivers summed values, only sums respectively being formed which may be formed for the individual curves A and B by themselves. Mixed terms $a_i*b_i$ do not occur, and the setpoint value is also fixed. This means that the product of curves C and D may simply be formed by examining curves A and B of FIGS. 2A and 2B by themselves. It is therefore sufficient for curve A to sum up the square of the measured values and the measured values themselves. Correspondingly, the measured values of curve B and the square of the measured values of curve B are summed up. Consequently, only four values have to be stored, namely, $\Sigma a_i^2$, $\Sigma b_i^2$, $\Sigma a_i$ and $\Sigma b_i$, in order to calculate the product of the two curves C and D. This is a comparatively simple computation, which especially does not require storing the entire course of curves A and B. Rather, it is sufficient, during two combustion periods, respectively to induce the lambda value of one of the four cylinders once in the direction towards rich and once in the direction towards lean.

By summing up the measured values and by summing up the squares of the measured values, during the combustion periods of these two, the product can then be calculated which is a measure for the deviation of the lambda value of the corresponding cylinder from the setpoint value. Consequently, by a simple summing up during the combustion period of these two for the respective cylinder, the deviation from the lambda setpoint value may be determined.

In FIGS. 2A–2D, of course, an idealized situation is shown, in which, in the case of the two curves A and B, over the course of time, there is the same shape of curve except for the range in which a deviation was deliberately provoked. In reality, however, the values scatter, so that at all times a certain proportion of curve C has a value different from zero over the entire range. Therefore, more than two periods, especially a plurality of combustion periods, should be evaluated, in order to ascertain these inducements from it. Accordingly, the controller that regulates the lambda value for the respectively induced cylinder should be set correspondingly slow, in order to smooth out these interferences. It is also meaningful to regulate succesively one after another all the cylinders, so as to achieve an improvement of the lambda regulation for the entire internal combustion engine. Furthermore, of course, the cross-influencing decreases from cylinder to cylinder if the deviations of the individual cylinders are already small, as shown in FIG. 2D. Alternatively, there is still another possibility, of first determining the deviations for all cylinders, and only after a complete run-through for all cylinders, then to carry out the adjustment for all the cylinders.

What is claimed is:

1. A method for controlling an internal combustion engine having a plurality of cylinders, the method comprising:

ascertaining a lambda value by evaluating a measured signal of a lambda probe in exhaust gas of the internal combustion engine;

comparing at least two combustion periods of the internal combustion engine to each other;

in each case in one individual cylinder of the plurality of cylinders of the internal combustion engine, inducing the lambda value once in a direction of a lambda increase and once in a direction of a lambda decrease; and for each of the at least two combustion periods by itself, summing-up the measured signal of the lambda probe and a square of the measured signal of the lambda probe.

2. The method according to claim 1, wherein a plurality of combustion periods of the internal combustion engine are compared to one another, in which in each case in one individual cylinder of the plurality of cylinders of the internal combustion engine the lambda value is induced once in the direction of a lambda increase and once in the direction of a lambda decrease.

3. The method according to claim 1, wherein the lambda value ascertained is used to regulate the lambda value of the cylinder at which an influencing of the lambda values was undertaken.

4. The method according to claim 3, wherein the lambda value is ascertained successively for the plurality of cylinders and is used respectively for a regulation of the cylinders.

5. The method according to claim 1, further comprising:

simultaneously modulating and thus identifying a group of the cylinders; and providing a regulation which then also acts upon the cylinder group.

* * * * *

UNITED STATES PATENT AND TRADEMARK OFFICE

CERTIFICATE OF CORRECTION

PATENT NO. : 7,117,861 B2
APPLICATION NO. : 11/149044
DATED : October 10, 2006
INVENTOR(S) : Labbe It is certified that error appears in the above-identified patent and that said Letters Patent is hereby corrected as shown below:

Column 4, line 26, change “soil.” to --soll.--

Signed and Sealed this

Twentieth Day of November, 2007

JON W. DUDAS
*Director of the United States Patent and Trademark Office*